US012405014B2

(12) United States Patent
Kim et al.

(10) Patent No.: US 12,405,014 B2
(45) Date of Patent: Sep. 2, 2025

(54) OUTDOOR UNIT OF AIR CONDITIONER

(71) Applicant: LG ELECTRONICS INC., Seoul (KR)

(72) Inventors: Junhee Kim, Seoul (KR); Siyoung Oh, Seoul (KR); Hyoungjune Kim, Seoul (KR); Siyoung Choi, Seoul (KR); Jonghae Lee, Seoul (KR); Gwansoo Lee, Seoul (KR); Kiyoon Park, Seoul (KR); Hyunwook Bae, Seoul (KR); Taegyu Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 137 days.

(21) Appl. No.: 18/502,311

(22) Filed: Nov. 6, 2023

(65) Prior Publication Data

US 2025/0012459 A1 Jan. 9, 2025

(30) Foreign Application Priority Data

Jul. 5, 2023 (KR) ..... 10-2023-0086994

(51) Int. Cl.

| | |
|---|---|
| ***F24F 1/38*** | (2011.01) |
| ***F04D 29/52*** | (2006.01) |
| ***F04D 29/54*** | (2006.01) |
| ***F24F 1/40*** | (2011.01) |

(52) U.S. Cl.

CPC ..... *F24F 1/38* (2013.01); *F04D 29/526* (2013.01); *F04D 29/541* (2013.01); *F24F 1/40* (2013.01)

(58) Field of Classification Search

CPC ..... F24F 1/38; F04D 29/526; F04D 29/541

See application file for complete search history.

(56) References Cited

U.S. PATENT DOCUMENTS

| | | | | |
|---|---|---|---|---|
| 6,450,760 | B1 * | 9/2002 | Furukawa | F04D 29/384 416/189 |
| 9,062,888 | B2 * | 6/2015 | Tadokoro | F04D 29/545 |
| 9,683,580 | B2 * | 6/2017 | Tyler | F01P 11/10 |
| 9,829,010 | B2 * | 11/2017 | Yoshida | F04D 29/164 |
| 11,009,042 | B2 * | 5/2021 | Takeuchi | F04D 29/164 |
| 11,181,125 | B2 * | 11/2021 | Chang | F04D 25/0646 |

(Continued)

FOREIGN PATENT DOCUMENTS

| | | |
|---|---|---|
| EP | 2175214 | 4/2010 |
| JP | 2009-203980 | 9/2009 |

(Continued)

OTHER PUBLICATIONS

Machine translation of KR20200043847 (Year: 2025).*

(Continued)

*Primary Examiner* — Christopher R Zerphey

(74) *Attorney, Agent, or Firm* — KED & ASSOCIATES

(57) ABSTRACT

An outdoor unit of an air conditioner may include a base panel, a front panel disposed on a front end of the base panel and having a through hole formed therein, an orifice fitted to the through hole, a fan disposed behind the through hole and having at least a portion accommodated inside of the orifice, and a heat exchanger disposed on or at an edge of a rear side of the base panel. A frontward-to-backward width of a first side end of the orifice may be less than a frontward-to-backward of a second side end of the orifice.

7 Claims, 6 Drawing Sheets

(56) References Cited

U.S. PATENT DOCUMENTS

| | | | | |
|---|---|---|---|---|
| 11,209,011 | B2 * | 12/2021 | Kim | F24F 1/38 |
| 2007/0280829 | A1 * | 12/2007 | Stevens | F04D 29/164 416/189 |
| 2010/0199716 | A1 | 8/2010 | Murakami et al. | |
| 2010/0269537 | A1 | 10/2010 | Tadokoro et al. | |
| 2013/0142460 | A1 | 6/2013 | Ng | |
| 2016/0341220 | A1 * | 11/2016 | Kondou | F04D 29/164 |
| 2017/0167773 | A1 | 6/2017 | Jeon | |
| 2017/0350412 | A1 * | 12/2017 | Hioki | F04D 29/5833 |

FOREIGN PATENT DOCUMENTS

| | | |
|---|---|---|
| JP | 4690682 | 6/2011 |
| KR | 10-2007-0046463 | 5/2007 |
| KR | 10-1734722 | 5/2017 |
| KR | 10-2020-0043847 | 4/2020 |
| KR | 10-2022-0078299 | 6/2022 |
| WO | WO 2009/0113338 | 9/2009 |

OTHER PUBLICATIONS

Machine translation of JP2009203980 (Year: 2025).*
Optimization of flow performance by designing orifice shape of outdoor unit of air-conditioner, Seo-Yoon Ryu et al., The Journal of the Acoustical Society of Korea vol. 36, No. 6 (2017).
Korean Office Action dated Dec. 11, 2024 issued in Application No. 10-2023-0086994.
European Search Report issued in Application No. 23202391.1 dated Mar. 11, 2024.

* cited by examiner

OUTDOOR UNIT OF AIR CONDITIONER

CROSS-REFERENCE TO RELATED APPLICATION(S)

The present application claims the benefits of priority to Korean Patent Application No. 10-2023-0086994, filed in Korea on Jul. 5, 2023, the contents of which is incorporated herein by reference in its entirety.

BACKGROUND

1. Field

An outdoor unit of an air conditioner is disclosed herein.

2. Background

An air conditioner is a device that cools and heats an indoor space through heat exchange between a refrigerant flowing through a heat exchange cycle and indoor air and outdoor air. More specifically, the air conditioner includes a compressor that compresses the refrigerant, an outdoor heat exchanger that exchanges heat between the refrigerant and outdoor air, and an indoor heat exchanger that exchanges heat between the refrigerant and indoor air.

The air conditioner may be equipped with a heat storage tank. In the heat storage tank, a fluid heated or cooled by the refrigerant circulating in the air conditioner may be stored. For example, the fluid may include water.

The outdoor unit of the air conditioner includes a case, the compressor accommodated inside of the case, the outdoor heat exchanger, and the heat storage tank. An orifice is provided on a front surface of the outdoor unit, and a fan is provided between the orifice and the outdoor heat exchanger. The fan may be an axial fan. The orifice forms a flow path for air forced to flow by the axial fan, and guides the air, which has passed through the outdoor heat exchanger, to flow in an axial direction of the fan and to be discharged outside of the outdoor unit.

Air passing through the orifice generates noise as it passes through blades of the fan. The noise is generated by formation of a vortex in a gap formed between an end of the blade and an inner circumferential surface of the orifice. As flow resistance is generated by the vortex, there is a disadvantage in that the air that has passed through the outdoor heat exchanger cannot be quickly discharged outside of the outdoor unit.

BRIEF DESCRIPTION OF THE DRAWINGS

Embodiments will be described in detail with reference to the following drawings in which like reference numerals refer to like elements, and wherein.

DETAILED DESCRIPTION

Figure 1:
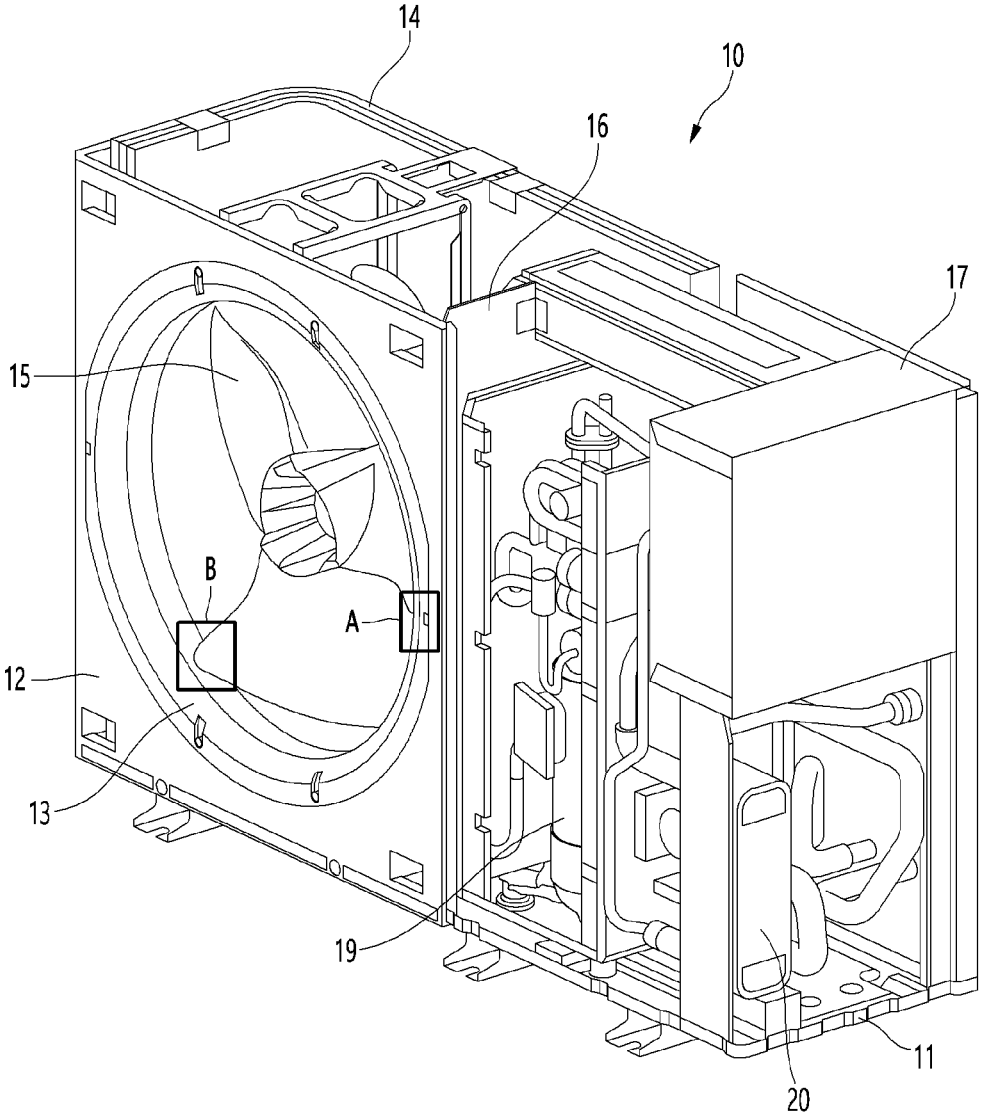
FIG. 1 is a perspective view of an outdoor unit configuring an air conditioner equipped with a heat storage tank according to an embodiment.

Hereinafter, an outdoor unit of an air conditioner according to an embodiment will be described with reference to the drawings. Wherever possible, like reference numerals have been used to indicate like components, and repetitive disclosure has been omitted.

FIG. 1 is a perspective view of an outdoor unit configuring an air conditioner equipped with a heat storage tank according to an embodiment. Referring to FIG. 1, outdoor unit 10 of the air conditioner according to an embodiment may include a base panel 11, a front panel 12 disposed at a front end of the base panel 11, an orifice 13 coupled to the front panel 12, a fan 15 disposed behind the orifice 13, and a heat exchanger 14 disposed on an upper surface of the base panel 11.

The outdoor unit 10 may further include a barrier 16 disposed on an upper surface of the base panel 11. The barrier 16 may be understood as a partition that partitions an upper space of the base panel 11 into a heat exchange space on a left or first side and an electrical equipment space on a right or second side. In addition, the heat exchanger 14 may be erected in the heat exchange space and be bent and extend along side and rear ends of the base panel 11 to define side and rear surfaces of the heat exchange space.

One or a first side end of the front panel 12 may be coupled to a front end of the heat exchanger 14, and the other or a second side end may be coupled to a front end of the barrier 16. A rear end of the barrier 16 may be connected to a side end of the heat exchanger 14.

The outdoor unit 10 may further include a compressor 19 disposed on the upper surface of the base panel 11 corresponding to the electrical equipment space, a heat storage tank 20, and a control box 17 located above the heat storage tank 20. The heat storage tank 20 may be spaced apart from the compressor 19, and a flow path may be provided inside of the heat storage tank 20 to enable heat exchange between refrigerant and water without mixing.

When the fan 15 rotates, outside air flows into the outdoor unit 10 through a short side of the heat exchanger 14 forming a side surface of the outdoor unit 10 and a long side of the heat exchanger 14 forming a rear surface of the outdoor unit 10. Air, which has passed through the heat exchanger 14, flows from a rear surface of the fan 15 toward a front surface thereof, passes through the orifice 13, and is then discharged outside of the outdoor unit 10. At least some of a plurality of blades 151 of the fan 15 are accommodated inside of the orifice 13 so that all air forced to flow by the fan 15 passes through the orifice 13.

Figure 2:
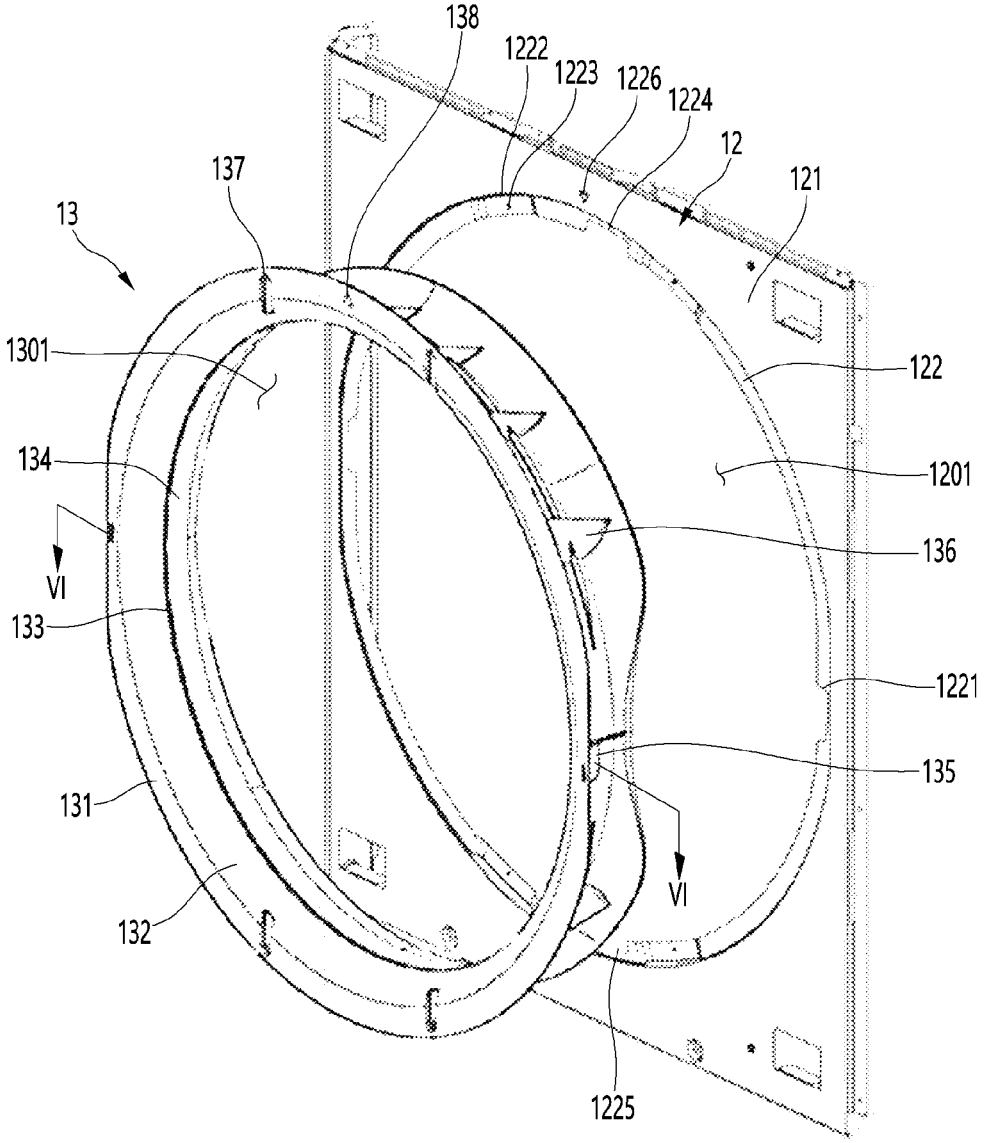
FIG. 2 is an exploded perspective view showing a state of coupling an orifice and a front panel according to an embodiment.
Figure 3:
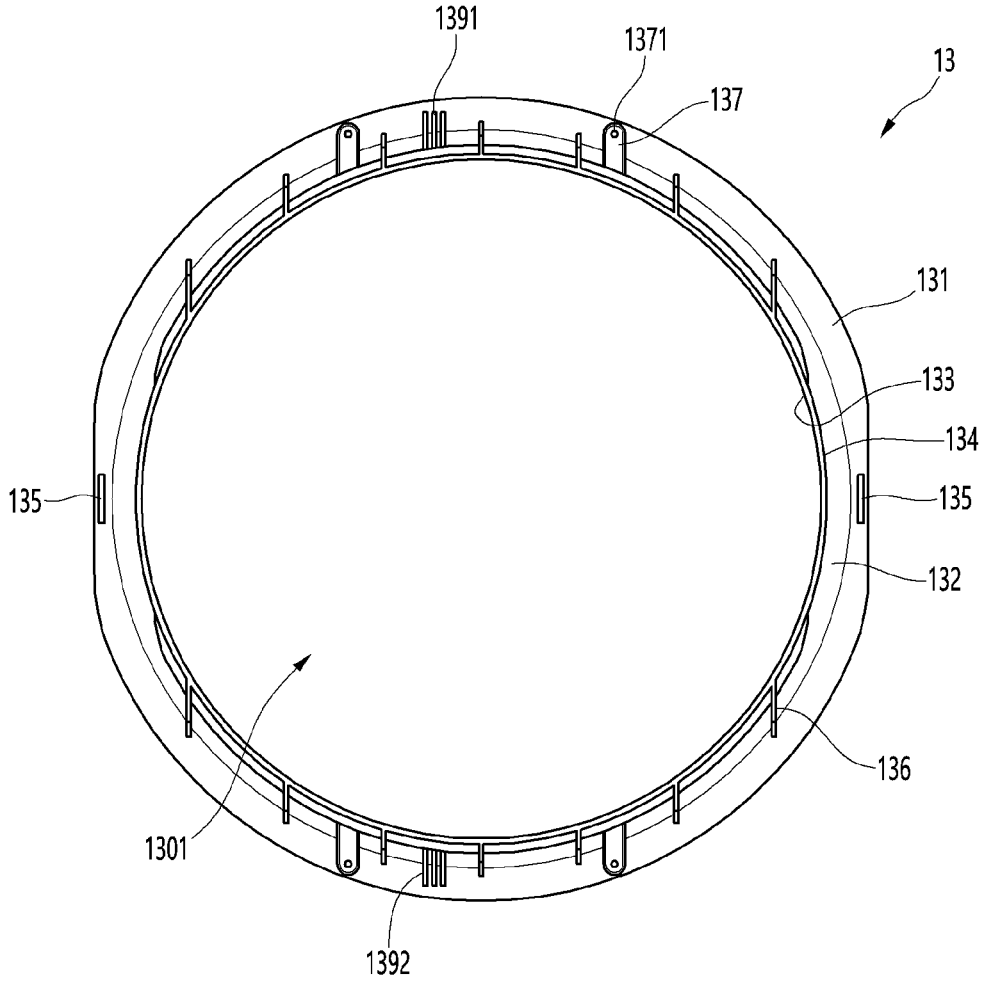
FIG. 3 is a rear view of the orifice of FIG. 2.

FIG. 2 is an exploded perspective view showing a state of coupling an orifice and a front panel according to an embodiment. FIG. 3 is a rear view of the orifice of FIG. 2.

Referring to FIGS. 2 and 3, the front panel 12 to which the orifice 13 is coupled may include a panel body 121 in the form of a rectangular plate. The panel body 121 may have a through hole 1201 formed therein. The orifice 13 may be fitted into and coupled to the through hole 1201.

More specifically, a fastening sleeve 122 that fastens the orifice 13 to the front panel 12 may extend from an edge of the through hole 1201. The fastening sleeve 122 may be bent toward a front side of the front panel 12 and contact a side surface of the orifice 13.

A plurality of fastening steps 1222 may be formed in the fastening sleeve 122, and a screw hole 1223 may be formed in each fastening step 1222. For example, the plurality of fastening steps 1222 may be formed on upper left and right (first and second) sides and lower left and right (third and fourth) sides, respectively, based on a vertical line bisecting the through hole 1201 into left and right (first and second) sides.

A misassembly prevention groove 1224 may be formed in the fastening sleeve 122 corresponding to a space between adjacent fastening steps. The misassembly prevention groove 1224 may be formed in upper and lower ends of the fastening sleeve 122. In addition, a pair of misassembly prevention grooves 1224 may be formed on the left or right side of the vertical line bisecting the through hole 1201.

One or more hook grooves 1221 may be formed in the fastening sleeve 122. For example, the hook grooves 1221 may be formed at positions facing each other on the left and right sides of the through hole 1201.

A coupling guide 1226 may be formed on the front surface of the front panel 12. The coupling guide 1226 functions to guide the orifice 13 to be correctly coupled to or at a correct position, and may be formed at any point between an upper end of the through hole 1201 and an upper end of the panel body 121. The coupling guide 1226 may have an inverted triangle shape. Also, a portion of the panel body 121 may protrude forward due to a forming process.

The orifice 13 may include a panel seating portion 131 configured to be in close contact with the front surface of the front panel 12, a diffuser 132 rounded backward from the panel seating portion 131, an inducer 134 that extends roundly backward from a rear end of the diffuser 132, a vortex fence 133 that surrounds the inner circumferential surface of the orifice 13 corresponding to a boundary between the diffuser 132 and the inducer 134, and through-hole 1301.

More specifically, the rear end of the inducer 134 may be defined as the rear end of the orifice 13, and the panel seating portion 131 may be defined as a front surface of the orifice 13. In addition, the diffuser 132 may include a rounded portion rounded such that a diameter thereof decreases as it extends rearward from a rear end of the panel seating portion 131, and a straight portion that extends rearward from a rear end of the rounded portion. In addition, the inducer 134 may include a straight portion that extends rearward from the straight portion of the diffuser 132 and a rounded portion that is rounded in a direction in which a diameter thereof increases as it extends rearward from a rear end of the straight portion.

With this structure, the orifice 13 may be described a cylindrical body including a front extension (diffuser 132) that is rounded forward from a front end of the body, a rear extension (inducer 134) that is rounded rearward from a rear end of the body, and a close contact portion (panel seating portion 131) that extends from a front end of the front extension and comes into close contact with the front surface of the front panel 12. In addition, the vortex fence 133 may protrude from an inner circumferential surface of the body and surround it in a band shape.

A plurality of reinforcing ribs 136 may protrude from an outer circumferential surface of the orifice 13. The plurality of reinforcing ribs 136 may be spaced apart in a circumferential direction of the orifice 13.

Fastening hooks 135 may protrude from a back surface of the panel seating portion 131. The fastening hooks 135 may be inserted into the hook grooves 1221 of the front panel 12. Accordingly, the fastening hooks 135 may also be formed on the left and right sides of the orifice 13, respectively.

A plurality of fastening steps 137 may be formed in or at the front surface of the orifice 13, and a screw hole 1371 may be formed in each fastening step 137. The plurality of fastening steps 137 may be formed at positions corresponding to the plurality of fastening steps 1222 formed on the front panel 12, respectively. That is, the plurality of fastening steps 137 may be formed on the left and right sides of the front upper and lower ends of the orifice 13, respectively.

A coupling guide 138 may be formed at an upper end of the panel seating portion 131. The coupling guide 138 may be formed at a position facing the coupling guide 1226 formed on the front panel 12, and may have an equilateral triangle shape; however, embodiments are not limited thereto.

More specifically, when the orifice 13 is completely coupled to the front panel 12, the coupling guides 138 and 1226 may be located on a same vertical line. The coupling guides 138 and 1226 prevent upper and lower surfaces of the orifice 13 from being reversed and combined. More specifically, as left and right portions of the orifice 13 according to embodiments form an asymmetrical shape, there is a limitation in that the upper and lower portions should not be reversed and combined. To prevent such misassembly, the coupling guides 138 and 1226 are provided.

As an additional unit for preventing misassembly, misassembly prevention ribs may be formed on the back surface of the orifice 13. The misassembly prevention ribs may include upper misassembly prevention rib 1391 formed on an upper side of the back surface of the orifice 13 and lower misassembly prevention rib 1392 formed on a lower side of the back surface. The upper and lower misassembly prevention ribs 1391 and 1392 may be respectively fitted into the upper and lower misassembly prevention grooves 1224 and 1225 of the front panel 12. Accordingly, the upper and lower misassembly prevention ribs 1391 and 1392 may also be formed at points spaced to the left or right from the vertical line bisecting the orifice 13.

Figure 4:
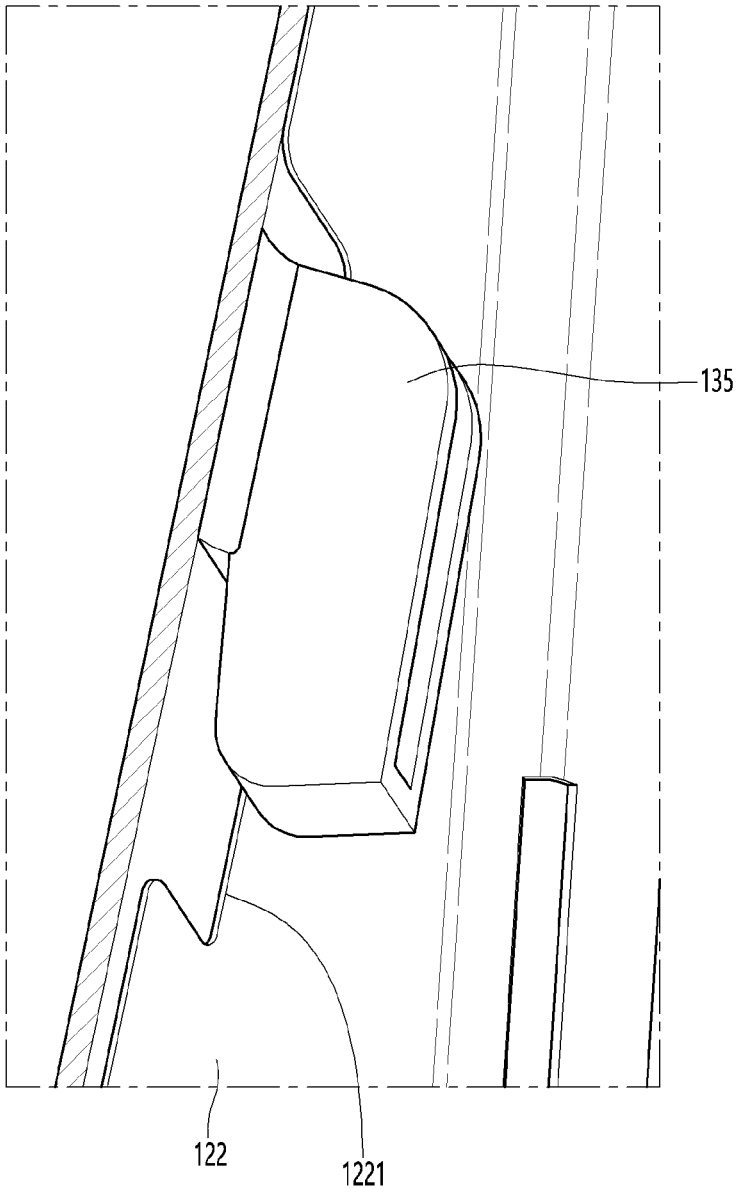
FIGS. 4 and 5 are enlarged views of a portion A of FIG. 1, showing a state in which a fastening hook of the orifice is inserted into a hook groove of the front panel according to an embodiment.
Figure 5:
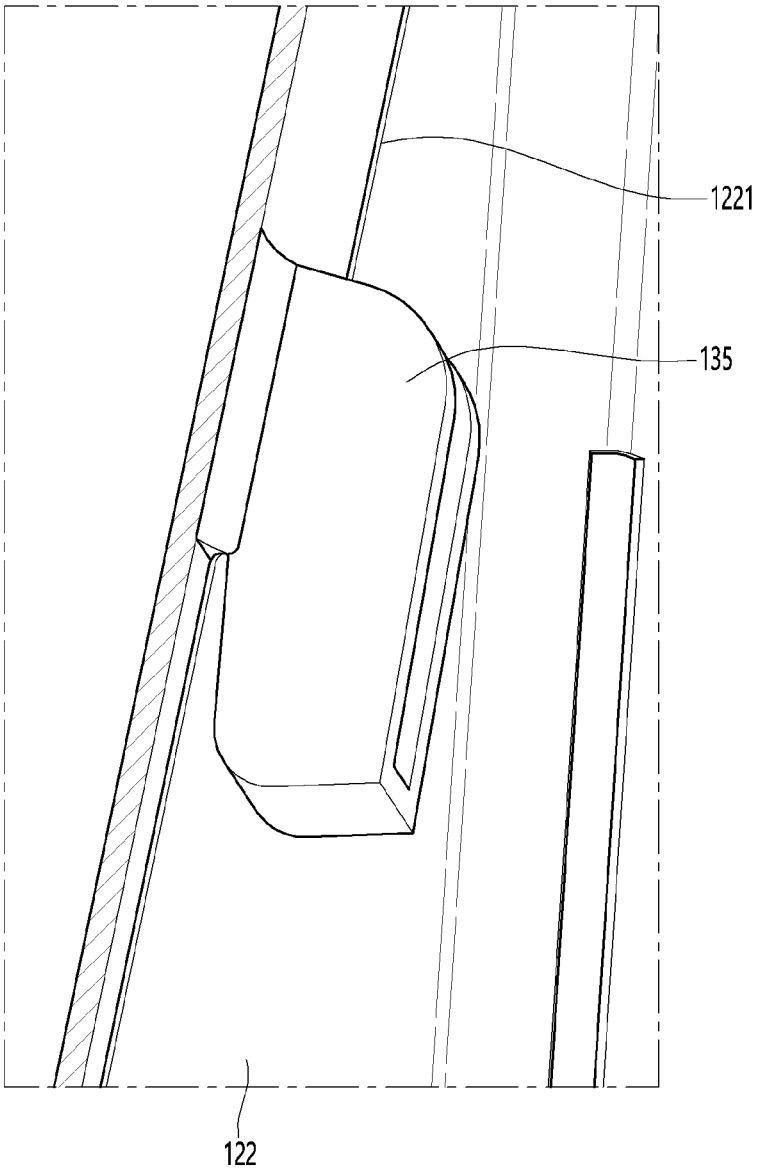

FIGS. 4 and 5 are enlarged views of a portion A of FIG. 1, showing a state in which the fastening hook of the orifice is inserted into the hook groove of the front panel. Referring to FIG. 4, the fastening hooks 135 are formed on the left and right sides of the orifice 13, respectively, and are formed symmetrically with respect to a horizontal line. That is, the fastening hook 135 on the right may extend downward clockwise in the drawing, and the fastening hook 135 on the left may extend upward clockwise.

More specifically, when the orifice 13 is in close contact with the front surface of the front panel 12, a lower end of the fastening hook 135 is fitted into the hook groove 1221. In this state, when the orifice 13 rotates clockwise, the fastening hook 135 on the right side rotates from an upper end to a lower end of the hook groove 1221 and is caught in the lower end of the hook groove 1221. Conversely, the fastening hook 135 on the left rotates from the lower end to the upper end of the hook groove 1221 and is caught in the upper end of the hook groove 1221. The structure of the fastening hook 135 and the hook groove 1221 may reduce the number of fastening steps 1222 and 137 for screw coupling, thereby shortening an assembly time and reducing manufacturing costs.

Figure 6:
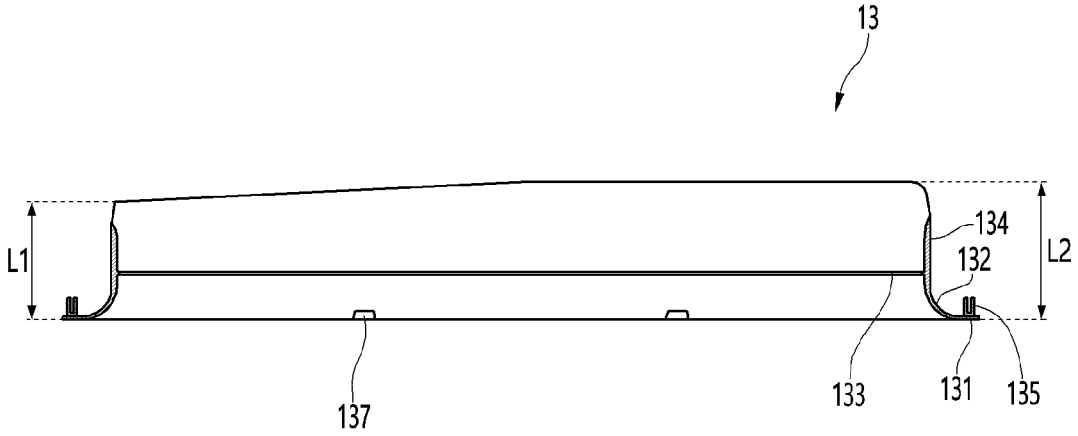
FIG. 6 is a cross-sectional view of the orifice, taken along line VI-VI of FIG. 2.

FIG. 6 is a cross-sectional view of the orifice, taken along line VI-VI of FIG. 2. Referring to FIG. 6, left and right (first and second) ends of the orifice 13 according to embodiments are designed to have different widths in a frontward-to-backward direction.

More specifically, the left portion of the orifice 13 adjacent to a short side of the heat exchanger 14 and the right portion of the orifice 13 adjacent to the barrier 16 are designed to have different shapes. More specifically, the larger the frontward-to-backward width of the orifice 13, the larger an area for accommodating the blades 151 of the fan 15, which has the advantage of increasing air volume. However, if the width of the left portion of the orifice 13 adjacent to the short side of the heat exchanger 14 increases, outside air suctioned through the short side of the heat exchanger 14 may flow into the orifice 13, and there is a disadvantage in that flow resistance increases. In order to overcome this problem, the frontward-to-backward width L2 of the right portion of the orifice 13 is designed to be larger than the frontward-to-backward width L1 of the left portion of the orifice 13.

Accordingly, a left rear end of the orifice 13 is formed to be tapered so that the frontward-to-backward width increases linearly from the left end of the orifice 13 to a center of the orifice 13, as shown. A right rear end of 13 of the orifice 13 is formed parallel to the front surface of the orifice 13.

Figure 7:
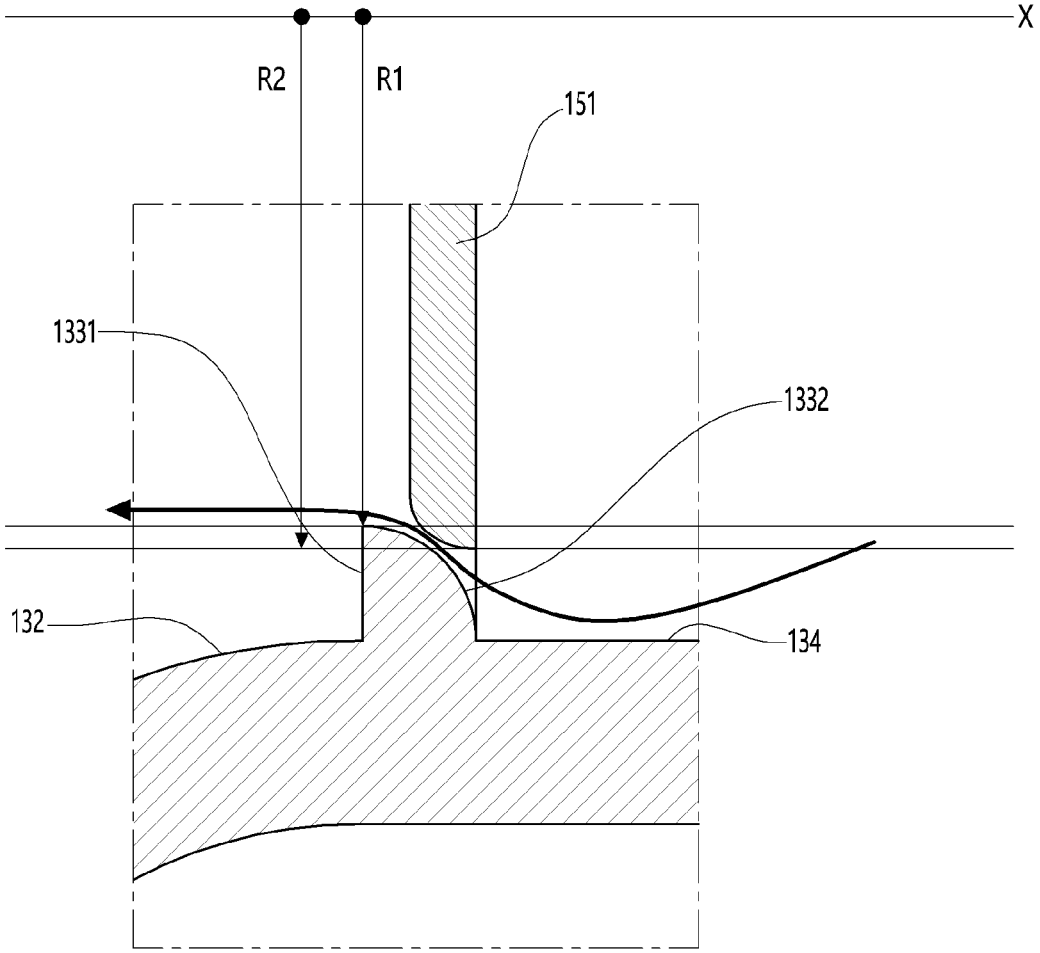
FIG. 7 is an enlarged cross-sectional view of a portion B of FIG. 1.

FIG. 7 is an enlarged cross-sectional view of a portion B of FIG. 1. Referring to FIG. 7, the fan 15 is provided in a form in which at least some of the blades are accommodated inside of the orifice 13, so that all air flowing by the fan 15 passes through the orifice 13.

More specifically, the blade 151 of the fan 15 is located at a rear side of the vortex fence 133, and outer diameter R2 of the blade 151 may be designed to be larger than or equal to inner diameter R1 of the vortex fence 133.

As the suctioned air passes through a gap formed between the end of the blade 151 and the inner circumferential surface of the orifice 13, a vortex is formed. As the vortex fence 133 protrudes, formation of the vortex is suppressed or prevented, air volume increases, and noise is reduced.

The vortex fence 133 may include a straight portion 1331 that extends radially from the inner circumferential surface of the orifice 13, and a rounded portion 1332 rounded from an upper end of the straight portion 1331 toward the inner circumferential surface of the orifice 13. The suctioned air passes over the rounded portion 1332 and is discharged to a front side of the outdoor unit 10.

Embodiments disclosed herein solve at least the above-discussed problems.

An outdoor unit of an air conditioner according to embodiments disclosed herein may include a base panel, a front panel erected or disposed on a front end of the base panel and having a through hole formed therein, an orifice fitted to the through hole, a fan placed or disposed behind the through hole and having at least a portion accommodated inside of the orifice, and a heat exchanger placed or disposed on or at an edge of a rear side of the base panel. A frontward-to-backward width of one or a first side end of the orifice is less than that of the other or a second side end of the orifice. The heat exchanger may include a short side that extends along one or a first side end of the base panel and a long side bent from a rear end of the short side and extending along a rear end of the base panel, one end of the orifice may be adjacent to the short side, and the frontward-to-rearward width of the orifice may increase linearly from one end of the orifice to a center of the orifice.

The orifice may include a cylindrical body, a front extension rounded forward from a front end of the body, a close contact portion that extends from a front end of the front extension and configured to come into close contact with a front surface of the front panel, and a rear extension rounded rearward from a rear end of the body. A vortex fence may protrude from an inner circumferential surface of the body to be formed in a band shape. A rear surface of the vortex fence may be formed to be rounded with a predetermined curvature.

An end of a blade forming the fan may be located behind the vortex fence. An outer diameter of the blade may be equal to or greater than an inner diameter of the vortex fence.

Coupling guides may be formed on a front surface of the front panel and the close contact portion, respectively. The coupling guides may be placed or disposed on a same vertical line in a state in which the orifice is completely coupled to the front panel A fastening sleeve may extend at or from an edge of the through hole. At least a portion of the fastening sleeve may be bent to or toward a front side of the front panel.

The outdoor unit according to embodiments disclosed herein may further include misassembly prevention ribs formed at upper and lower ends of a back surface of the front panel, respectively, and misassembly prevention grooves formed in or at upper and lower ends of the fastening sleeve, respectively, to accommodate the misassembly prevention ribs. The misassembly prevention ribs and the misassembly prevention grooves may be formed at points spaced to the left or right from a vertical line passing through a center of the through hole.

The outdoor unit according to embodiments disclosed herein may further include fastening hooks that protrude from a back surface of the close contact portion, and hook grooves formed in the fastening sleeve to accommodate the fastening hooks. When the orifice rotates in a state of being in close contact with the front panel, the fastening hooks are caught in the hook grooves.

The fastening hooks may protrude from left and right sides of a back surface of the close contact portion, respectively. The hook grooves may be formed in left and right sides of the fastening sleeve, respectively, and the pair of fastening hooks may be formed symmetrically with respect to a horizontal plane.

The outdoor unit of the air conditioner according to embodiments disclosed herein configured as described above has at least the following advantages.

First, a cross-section of the orifice has an asymmetric structure, which has the effect of increasing air volume.

Second, a vortex fence that suppresses or prevents vortex generation protrudes from the inner circumferential surface of the orifice, which has the effect of increasing air volume and reducing noise.

Third, by improving an assembly structure between the orifice and a front panel, there is an advantage in reducing the number of screws to secure the orifice to the front panel.

Fourth, there is an advantage in preventing misassembly of the orifice by providing a misassembly prevention unit to prevent the orifice having an asymmetric shape from being incorrectly assembled on the front panel.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor unit of an air conditioner, comprising:
- a base panel;
- a front panel disposed at a front end of the base panel and having a through hole formed therein;
- an orifice fitted to the through hole;
- a fan disposed behind the through hole, wherein at least a portion of the fan is accommodated inside of the orifice; and
- a heat exchanger disposed on an edge of a rear side of the base panel, wherein a frontward-to-backward width of a first side end of the orifice is less than a frontward-to-backward of a second side end of the orifice, wherein the heat exchanger comprises:
  - a first side that extends along a first side end of the base panel; and
  - a second side bent from a rear end of the second side and that extends along a rear end of the base panel, wherein the first side is shorter than the second side, wherein the first side end of the orifice is adjacent to the first side, wherein the frontward-to-backward width of the orifice increases linearly from the first side end of the orifice to a center of the orifice and is formed to extend parallel to a front surface of the orifice from the center of the orifice to the second side end of the orifice, wherein a fastening sleeve extends from an edge of the through hole of the front panel, wherein at least a portion of the fastening sleeve is bent toward a front side of the front panel, and wherein the outdoor unit further comprises:
    - misassembly prevention ribs formed at upper and lower ends of a back surface of the front panel, respectively; and
    - misassembly prevention grooves formed in upper and lower ends of the fastening sleeve, respectively, to accommodate the misassembly prevention ribs, wherein the misassembly prevention ribs and the misassembly prevention grooves are formed at points spaced to a first lateral side or a second lateral side with respect to a vertical line that passes through a center of the through hole.

2. The outdoor unit of claim 1, wherein the orifice comprises a cylindrical body including:
- a front extension rounded forward from a front end of the body;
- a close contact portion that extends from a front end of the front extension and configured to come into close contact with a front surface of the front panel; and
- a rear extension rounded rearward from a rear end of the body, wherein a vortex fence protrudes from an inner circumferential surface of the cylindrical body to be formed in a band shape.

3. The outdoor unit of claim 2, wherein a rear surface of the vortex fence is rounded with a predetermined curvature.

4. The outdoor unit of claim 2, wherein an end of a blade forming the fan is located behind the vortex fence, and wherein an outer diameter of the blade is equal to or greater than an inner diameter of the vortex fence.

5. The outdoor unit of claim 2, wherein coupling guides are formed on the front surface of the front panel and the close contact portion, respectively, and wherein the coupling guides are disposed on a same vertical line in a state in which the orifice is completely coupled to the front panel.

6. The outdoor unit of claim 1, further comprising:

fastening hooks that protrude from a back surface of the close contact portion; and hook grooves formed in the fastening sleeve to accommodate the fastening hooks, wherein when the orifice rotates in a state of being in close contact with the front panel, the fastening hooks are caught in the hook grooves.

7. The outdoor unit of claim 6, wherein the fastening hooks protrude from first and second sides of the back surface of the close contact portion, respectively, wherein the hook grooves are formed in first and second lateral sides of the fastening sleeve, respectively, and wherein the fastening hooks comprise a pair of fastening hooks formed symmetrically with respect to a horizontal plane.

* * * * *